US012352521B2

(12) United States Patent
Allred

(10) Patent No.: US 12,352,521 B2
(45) Date of Patent: Jul. 8, 2025

(54) MAGAZINE LOADER

(71) Applicant: Sterling Allred, Orem, UT (US)

(72) Inventor: Sterling Allred, Orem, UT (US)

( * ) Notice: Subject to any disclaimer, the term of this patent is extended or adjusted under 35 U.S.C. 154(b) by 0 days.

(21) Appl. No.: 18/635,520

(22) Filed: Apr. 15, 2024

(65) Prior Publication Data

US 2024/0344794 A1 Oct. 17, 2024

Related U.S. Application Data

(60) Provisional application No. 63/496,564, filed on Apr. 17, 2023.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
See application file for complete search history.

(56) References Cited

U.S. PATENT DOCUMENTS

| | | | | |
|---|---|---|---|---|
| 2,403,012 | A | 7/1946 | McPheters | |
| 4,614,052 | A | 9/1986 | Brown et al. | |
| 4,706,402 | A | 11/1987 | Csongor | |
| D297,854 | S | 9/1988 | Vyprachticky | |
| 6,754,987 | B1 | 6/2004 | Cheng et al. | |
| 7,059,077 | B2 | 6/2006 | Tal et al. | |
| 7,257,919 | B1 | 8/2007 | Farley | |
| 7,805,874 | B2 | 10/2010 | Tal et al. | |
| D697,999 | S | 1/2014 | Firment | |
| 9,273,917 | B1 | 3/2016 | Buckner | |
| 9,347,722 | B1 | 5/2016 | Morris | |
| D773,588 | S | 12/2016 | Wasankari | |
| D799,632 | S | 10/2017 | Ulbrich et al. | |
| D811,514 | S | 2/2018 | DiLeo | |
| D815,235 | S | 4/2018 | Grego et al. | |
| D818,554 | S | 5/2018 | Hefer et al. | |
| D829,293 | S | 9/2018 | Hefer et al. | |
| D829,295 | S | 9/2018 | Buckner | |
| 10,126,077 | B1 | 11/2018 | Glover | |
| 10,139,176 | B1 * | 11/2018 | Witecha | F41A 9/83 |
| D839,986 | S | 2/2019 | Bjegovich | |
| 10,274,275 | B1 * | 4/2019 | Terrell | F41A 9/83 |
| 10,345,065 | B2 | 7/2019 | Roe | |

(Continued)

OTHER PUBLICATIONS

US Design U.S. Appl. No. 29/937,424, filed Apr. 15, 2024.

(Continued)

*Primary Examiner* — J. Woodrow Eldred
(74) *Attorney, Agent, or Firm* — Thorpe North & Western, LLP

(57) ABSTRACT

A magazine loader assists in loading cartridges into a magazine of a firearm. An elongated sleeve has an open distal end and a hollow therethrough sized and shaped to receive a stack of cartridges. A collar at a proximal end of the sleeve has an enlarged opening sized and shaped to receive an open proximal end of the magazine. A plunger has a proximal end selectively receivable in the open distal end of the sleeve, and has an elongated shank slidable in the hollow of the sleeve and an enlarged head. The plunger presses the stack of cartridges through the hollow of the sleeve, out the enlarged opening of the collar and into the magazine.

20 Claims, 11 Drawing Sheets

(56) References Cited

U.S. PATENT DOCUMENTS

| | | | | |
|---|---|---|---|---|
| D861,822 | S | 10/2019 | Hellyar | |
| 10,746,487 | B2 | 8/2020 | Bian | |
| 11,029,108 | B1 * | 6/2021 | Tal | F41A 9/84 |
| 11,313,634 | B1 | 4/2022 | Newby et al. | |
| 11,624,574 | B1 | 4/2023 | Witecha | |
| 11,867,475 | B2 | 1/2024 | Kim et al. | |
| D1,040,282 | S | 8/2024 | Rhode | |
| 2013/0067788 | A1 | 3/2013 | Gray | |
| 2015/0377573 | A1 * | 12/2015 | Niccum | F41A 9/83 42/87 |
| 2017/0211902 | A1 | 7/2017 | Mills | |
| 2020/0182570 | A1 | 6/2020 | Bian | |
| 2024/0344794 | A1 | 10/2024 | Allred | |

OTHER PUBLICATIONS

Ludex Rifle Tubular 176 Round Speed Loader for .22/.17 Ammo, Design for Lever Action Tube Fed Rifles, Henry 22 Mag/22LR/22S Magazine Speed Loader, https://www.amazon.com/Ludex-Tubular-Magazine-Storage-Function/dp/B09GMF5CBT?th=1, accessed May 19, 2025, 10 pages.

* cited by examiner

MAGAZINE LOADER

PRIORITY CLAIM

Priority is claimed to U.S. Provisional Patent Application No. 63/496,564, filed Apr. 17, 2023, which is hereby incorporated herein by reference.

BACKGROUND

Some firearms have magazines that hold cartridges to be fired by the firearm. Some magazines are loaded by hand by individually inserting each cartridge into the magazine against an internal spring.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
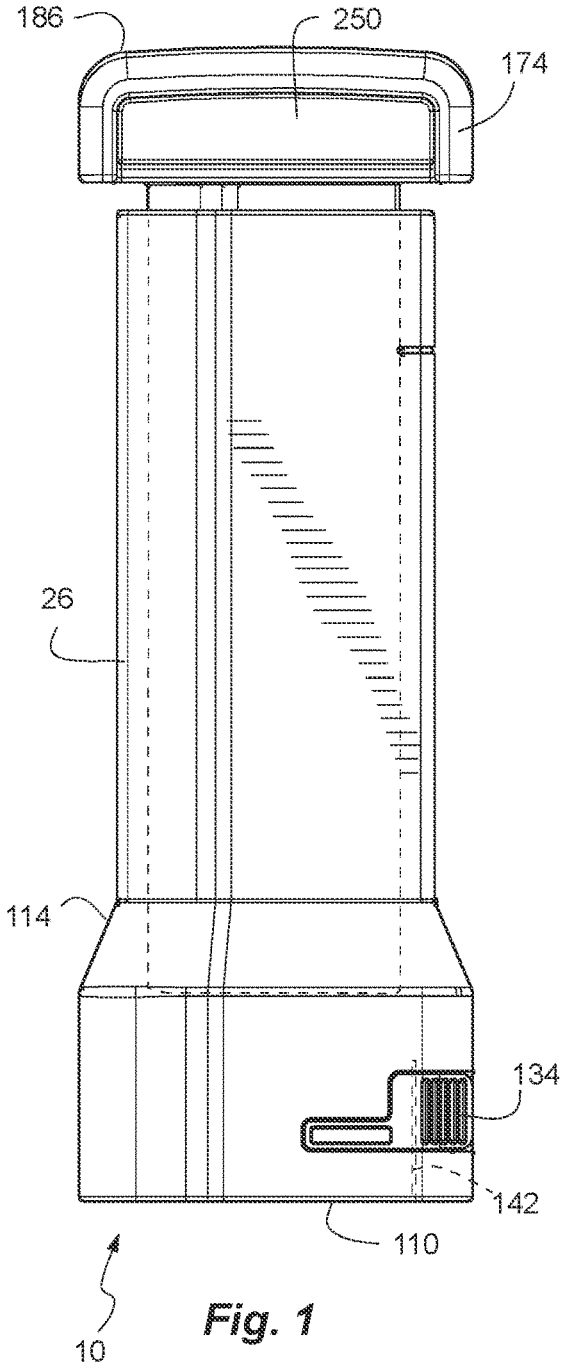
FIG. 1 is a side view of an example magazine loader according to an embodiment, shown with a plunger inserted into a sleeve, and without a magazine.
Figure 2:
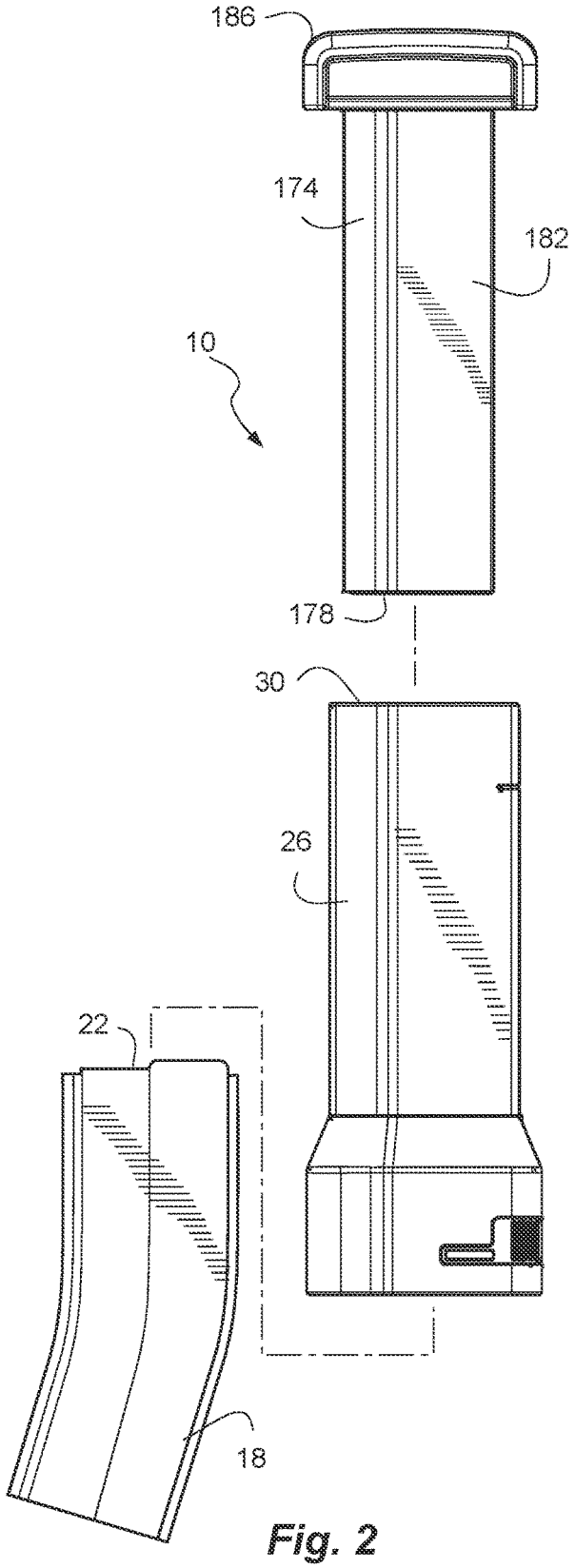
FIG. 2 is an exploded side view of the magazine loader of FIG. 1, shown with the plunger removed from the sleeve, and with the magazine removed from the sleeve.
Figure 3:
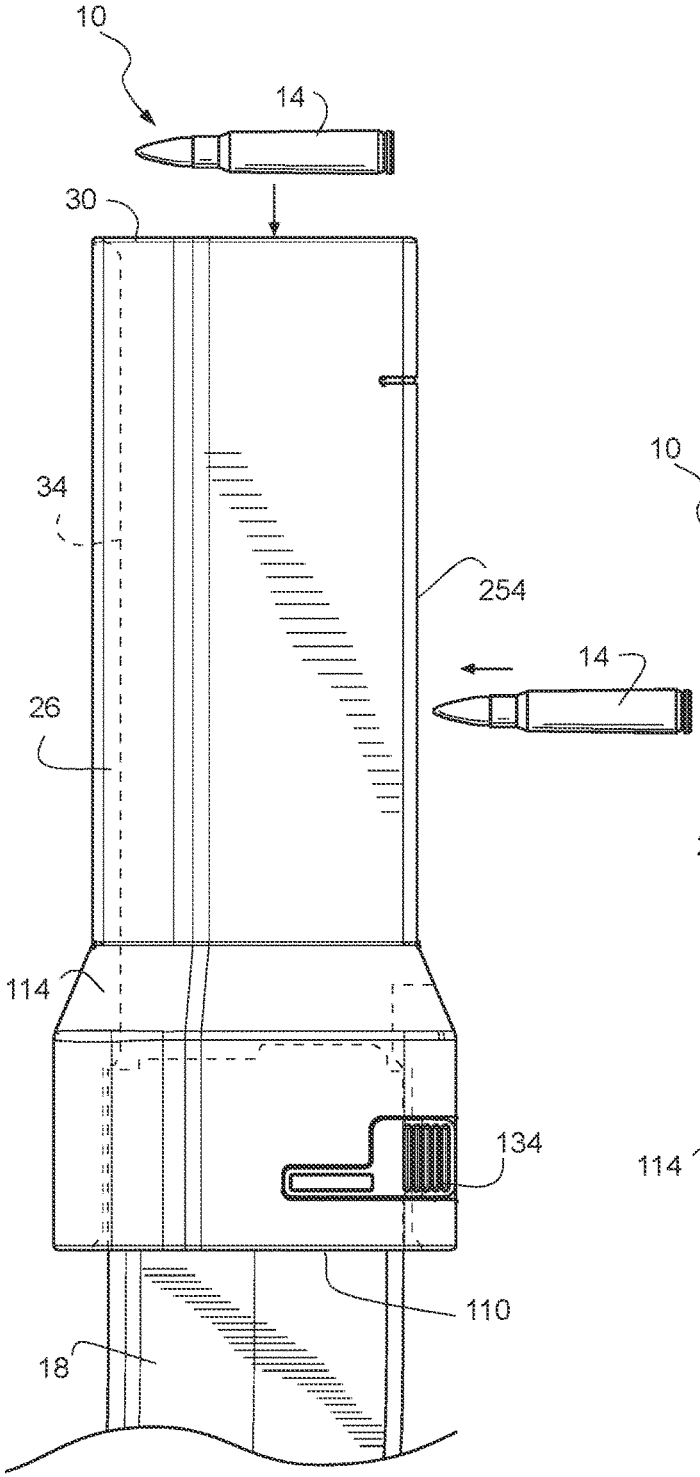
FIG. 3 is a side view of the sleeve of the magazine loader of FIG. 1, shown with the plunger removed, and with the magazine inserted into a collar of the sleeve, and schematically showing cartridges being inserted into the sleeve.
Figure 4:
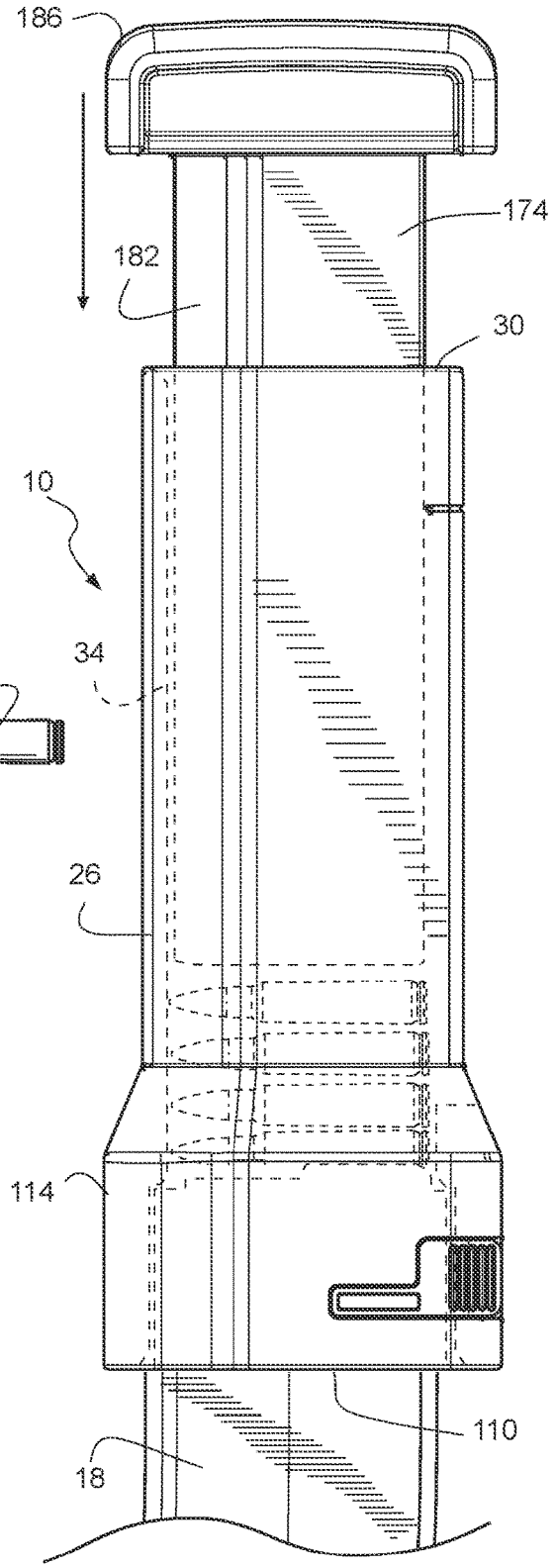
FIG. 4 is a side view of the magazine loader of FIG. 1, schematically showing the plunger pushing the cartridges into the magazine.
Figure 5:
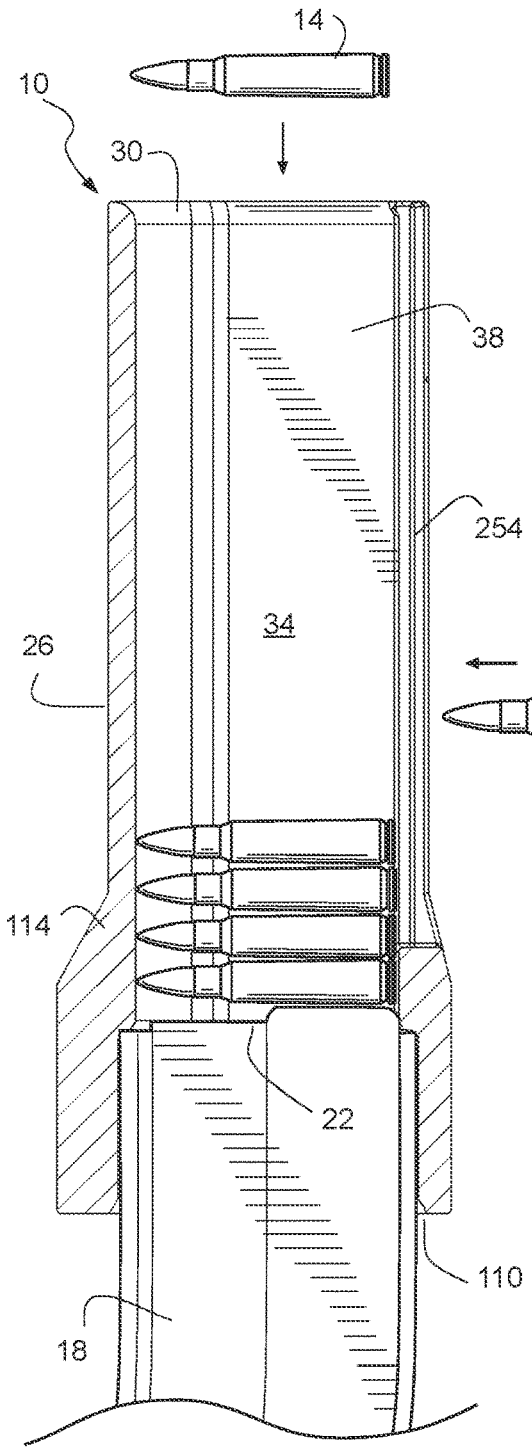
FIG. 5 is a partial cross-sectional side view of the sleeve of the magazine loader of FIG. 1, shown with the plunger removed, and with the magazine inserted into a collar of the sleeve, and schematically showing cartridges being inserted into the sleeve.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The invention presents a magazine loader to assist in loading cartridges into a magazine of a firearm. The loader can have an elongated sleeve with an open distal end, and open proximal end, and a hollow therethrough from the open distal end to the open proximal end. In one aspect, the hollow can be sized and shaped to receive a stack of cartridges. In another aspect, the hollow can have a cross-sectional shape that substantially matches a profile of the cartridges to resist cartridges from misaligning and/or binding in the hollow, and to indicate proper placement in the hollow of the sleeve. The sleeve and the hollow can be sized and shaped for a desired caliber of cartridge, such as .223, 5.56 NATO, .308, 9 mm, 45 ACP, .22, etc. The magazine loader also has a plunger with a proximal end selectively receivable in the open distal end of the sleeve. The plunger can have an elongated shank with a cross-sectional shape that substantially matches the cross-sectional shape of the hollow of the sleeve, and thus the profile of the cartridges, to indicate the proper orientation to insert the plunger, maintain the proper spacing of the plunger during use, more evenly distribute force from the plunger on a cartridge, and resist cartridges from catching between the shank and the hollow. The plunger can press the stack of cartridges in the hollow of the sleeve through the hollow of the sleeve, out the enlarged opening of the collar, and into the magazine.

Referring to FIGS. 1-26, an example of a loader or magazine loader 10 is shown to assist in loading cartridges 14 into a magazine 18 of a firearm. The magazine 18 can be removed from a firearm and can have an open proximal end 22 to receive the cartridges 14. The loader 10 can receive the open proximal end 22 of the magazine 18, and a stack of cartridges 14. The loader 10 can insert the stack of cartridges 14 from the loader 10 into the magazine 18.

The loader 10 can comprise an elongated sleeve 26 with an open distal end 30 and a hollow 34 therethrough extending from the open distal end 30. The hollow 34 can be sized and shaped to receive the stack of cartridges 14. In one aspect, the hollow 34 can have a shape to match the cartridges 14 to facilitate proper orientation of the cartridges 14 for loading into the magazine 18 and to resist binding of the cartridges 14 in the hollow 34. The hollow 34 can have a cartridge-shaped inner wall 38 with or formed by a cross-sectional profile of the hollow 34 taken perpendicularly to a longitudinal axis 42 (FIG. 11) of the hollow 34. The cartridge-shaped inner wall 38 can have a shape to match a cross-sectional profile 46 (FIG. 24) of a cartridge 14 of the stack of cartridges 14 taken along a longitudinal axis 50 of the cartridge 14.

Figure 11:
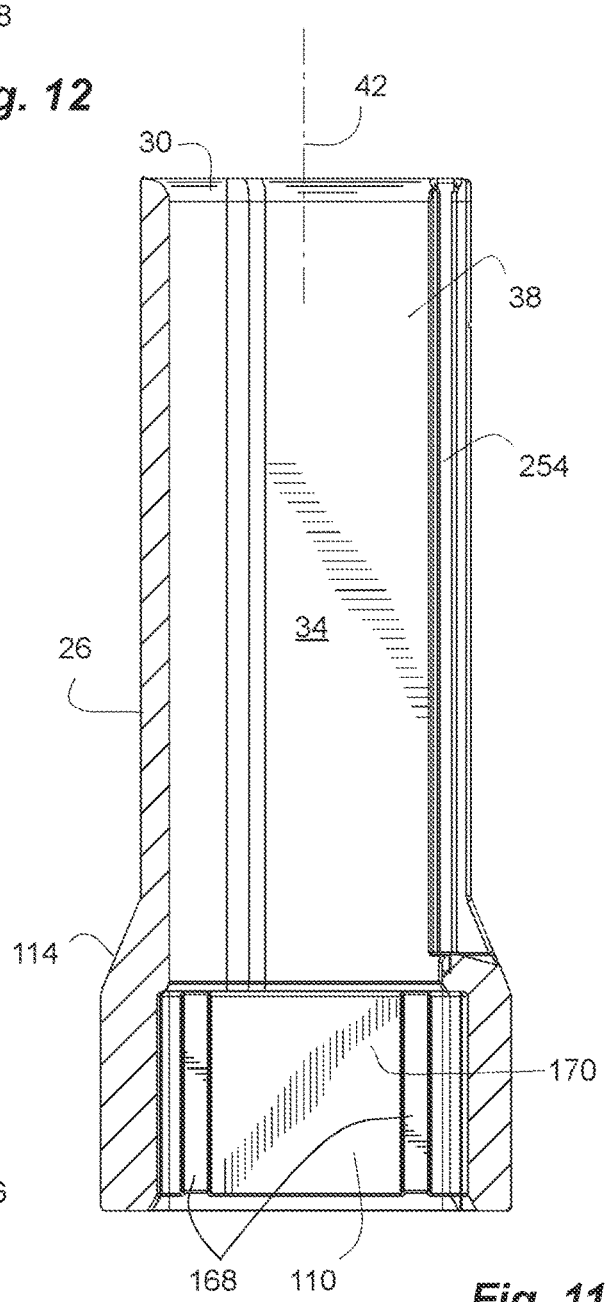
FIG. 11 is a cross-sectional side view of the sleeve of FIG. 7, taken along line 11 of FIG. 8.
Figure 25:
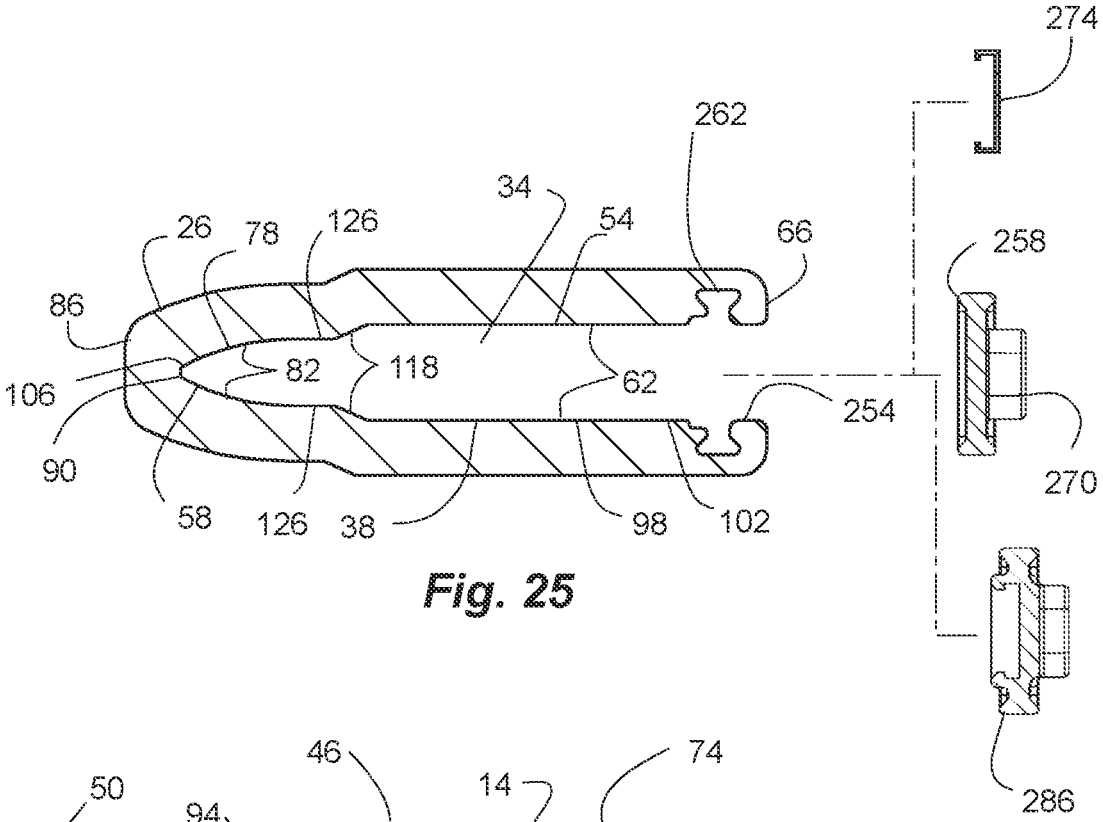
FIG. 25 is a cross-sectional bottom view of the sleeve of FIG. 7, taken along line 25 of FIG. 10.
Figure 24:
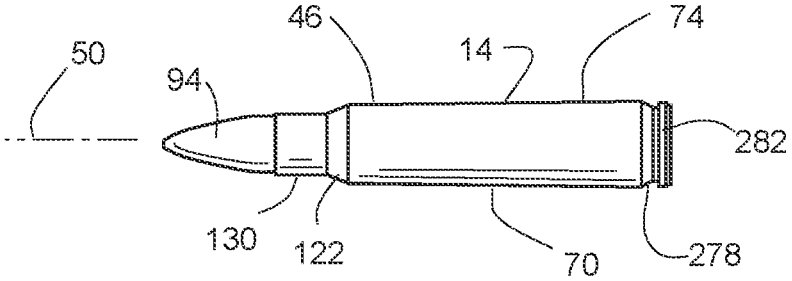
FIG. 24 is a side view of a cartridge for reference.

Referring to FIGS. 24 and 25, the cartridge-shaped inner wall 38 can have a cross-sectional profile that can comprise at least a rear rectangular shape 54 and a forward ogive shape 58. The rear rectangular shape 54 can comprise a pair of rear walls 62 that are straight, positioned closer to a rear 66 of the loader 10 or the sleeve 26, spaced-apart from one another, and oriented substantially parallel with respect to one another. The rear rectangular shape 54 and the pair of rear walls 62 can correspond to a body 70 of a case 74 of the cartridge 14. The forward ogive shape 58 can comprise an ogive 78 with a pair of front walls 82 that are curved, positioned closer to a front 86 of the loader 10 and the sleeve 26, and oriented transvers to one another to culminate in a tip 90. The ogive 78 can correspond to a bullet 94 of the cartridge 14. The cartridge-shaped inner wall 38 can also comprise a continuous perimeter 98 extending from a rear end 102 of the shape closer to the rear 66 of the loader 10 and the sleeve 26, and around a front end 106 of the shape closer to the front 86 of the loader 10 and the sleeve 26. In another aspect, the cartridge-shaped inner wall 38 of the hollow 34 of the sleeve 26 can extend substantially an entire length of the hollow 34 along the longitudinal axis 42 from the open distal end 30 of the sleeve 26 to an enlarged opening 110 of a collar 114, as shown in FIG. 11, to resist binding of the cartridges 14. The cartridge-shaped inner wall 38 can be configured to match a specific caliber.

In another aspect, the cartridge-shaped inner wall can be configured to further match a .223 or 5.56 NATO caliber cartridge. Thus, the cross-sectional profile of the cartridge-shaped inner wall 38 can further comprise a pair of intermediate angled walls 118 that are straight, positioned intermediate the pair of rear walls 62 and the ogive 78, spaced-apart from one another, and oriented transverse to one another. The pair of intermediate angled walls 118 can correspond to a shoulder 122 of the case 74 of the cartridge 14. The cartridge-shaped inner wall 38 can further comprise a pair of intermediate straight walls 126 that are straight, positioned intermediate the pair of intermediate angled walls 118 and the ogive 78, spaced-apart from one another, and oriented substantially parallel with respect to one another. The pair of intermediate straight walls 126 can correspond to a neck 130 of the case 74 of the cartridge 14. Again, the cartridge-shaped inner wall 38 can also comprise a continuous perimeter 98 extending from the rear end 102 of the shape closer to the rear 66 of the loader 10 and the sleeve 26, and around the front end 106 of the shape closer to the front 86 of the loader 10 and the sleeve 26. In another aspect, the entire cartridge-shaped inner wall 38 (except for a slot described herein) can match the entire profile of the cartridge 14 (except for the rear of the cartridge due to the slot).

Referring again to FIGS. 1-26, the sleeve 26 can have a collar 114 at a proximal end of the sleeve 26. The collar 114 can have an enlarged opening 110 sized and shaped to receive the open proximal end 22 of the magazine 18. In one aspect, the magazine 18 can be positively retained in the collar 114 with a catch 134. The catch 134 can be similar to a catch of a firearm to retain the magazine 18 in the firearm.

Referring to FIGS. 7-17, the catch 134 can comprise an arm 138 pivotally coupled to the collar 114 by a pin 142 (FIG. 1). The catch 134 can be pivotally disposed in a cavity 146 of the collar 114. A distal end 150 of the arm 138 can extend into the collar 114. The distal end 150 of the arm 138 can have an edge 154 facing away from the enlarged opening 110 of the collar 114. The edge 154 can abut to a corresponding edge of the magazine 18 when the magazine 18 is inserted to retain the magazine 18. The distal end 150 of the arm 138 can also have an inclined slope 158 opposite the edge 154 and facing towards the enlarged opening 110 of the collar 114. The magazine 18 can engage the inclined slope 158 when inserted to displace the distal end of the arm 138 and allow the magazine 18 to be inserted. A proximal end 162 of the arm 138 can extend outside the collar 114 or be accessible outside of the enlarged opening 110. The proximal end 162 of the arm 138 can have a tab 166 to be engaged to pivot the arm 138 and displace the distal end 150 and the edge 154 of the arm 138 and release the magazine 18. The catch 134 and the arm 138 can have two orientations, including a catch orientation and a release orientation. In the catch orientation, the edge 154 can be pivoted into the collar 114 and into engagement with the corresponding edge of the magazine 18. In the release orientation, the edge 154 can be pivoted away from the corresponding edge of the magazine 18 and away from the enlarged opening 110 of the collar 114. The catch 134 and the arm 138 can be biased in the catch orientation, such as by a spring positioned between the arm 138 and the collar 114.

Figure 13:
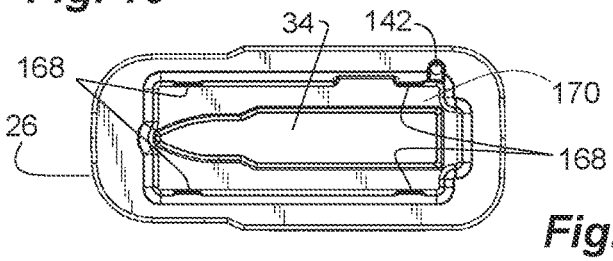
FIG. 13 is a bottom view of the sleeve of FIG. 7.
Figure 14:
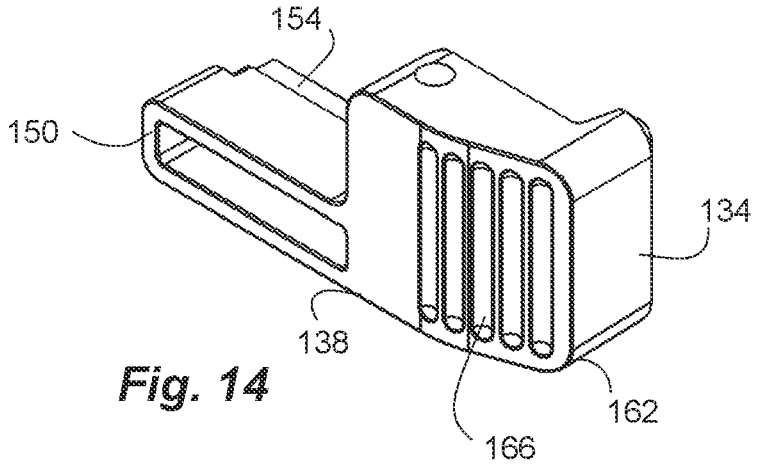
FIG. 14 is a perspective view of an example catch of the sleeve of the magazine loader of FIG. 1, according to an embodiment.
Figure 15:
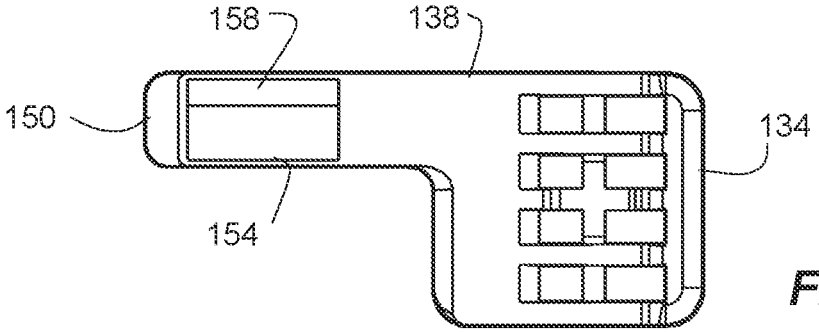
FIG. 15 is a rear view of the catch of FIG. 14.
Figure 16:
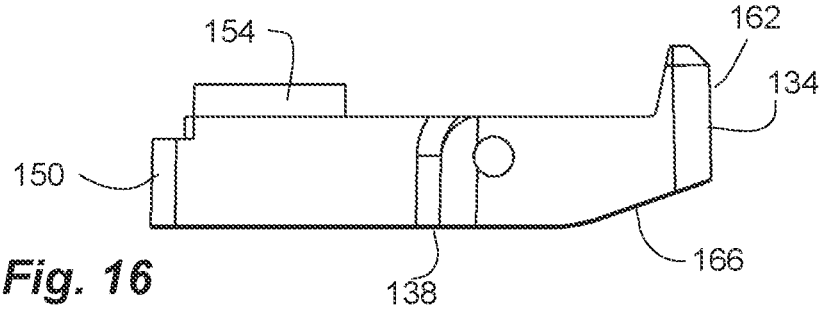
FIG. 16 is a top view of the catch of FIG. 14.
Figure 17:
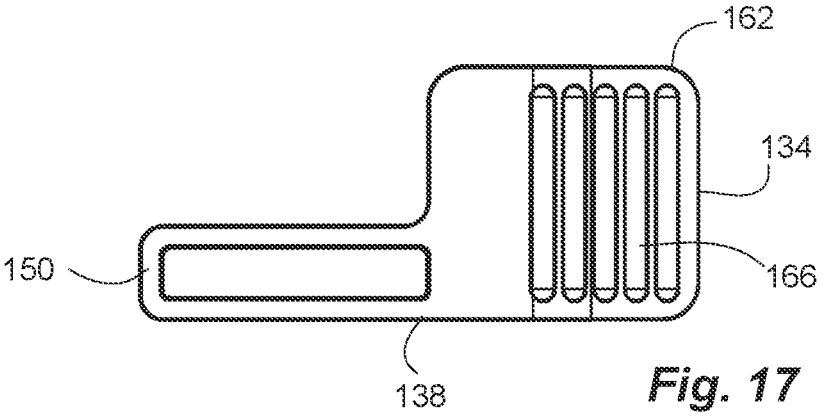
FIG. 17 is a front view of the catch of FIG. 14.
Figure 18:
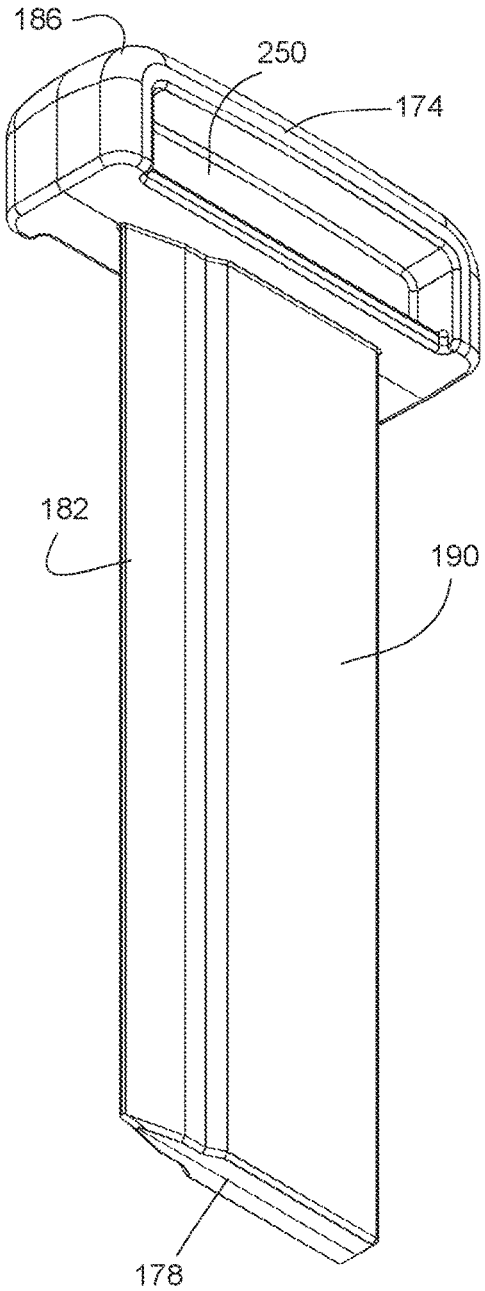
FIG. 18 is a perspective view of an example of the plunger of the magazine loader of FIG. 1, according to an embodiment.
Figure 19:
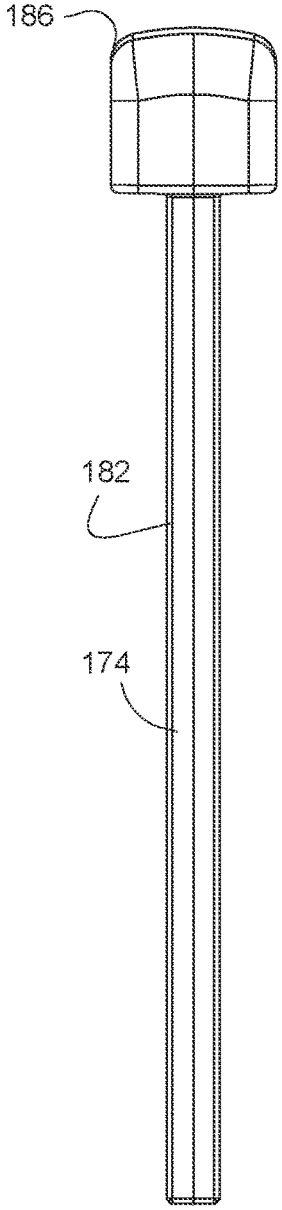
FIG. 19 is a rear view of the plunger of FIG. 18.
Figure 20:
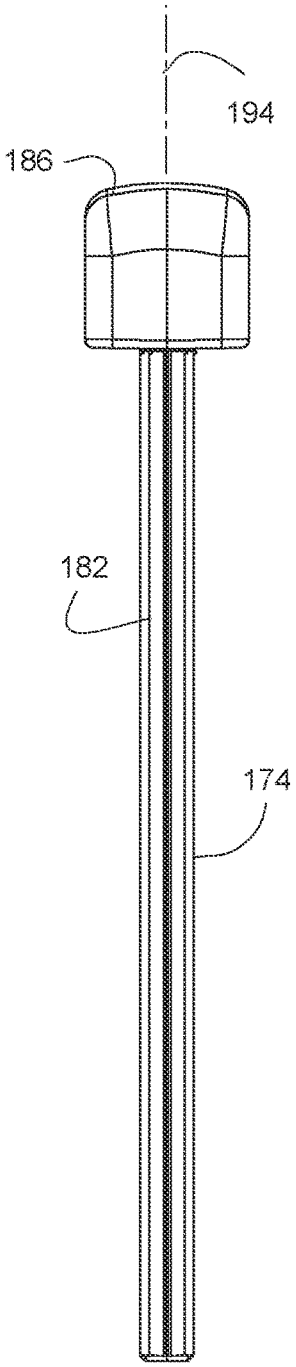
FIG. 20 is a front view of the plunger of FIG. 18.
Figure 23:
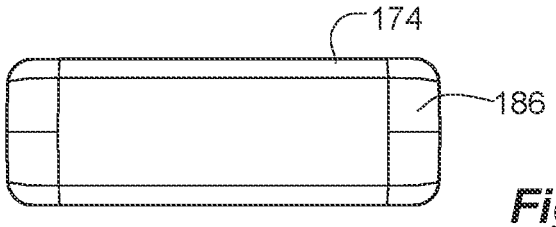
FIG. 23 is a top view of the plunger of FIG. 18.
Figure 21:
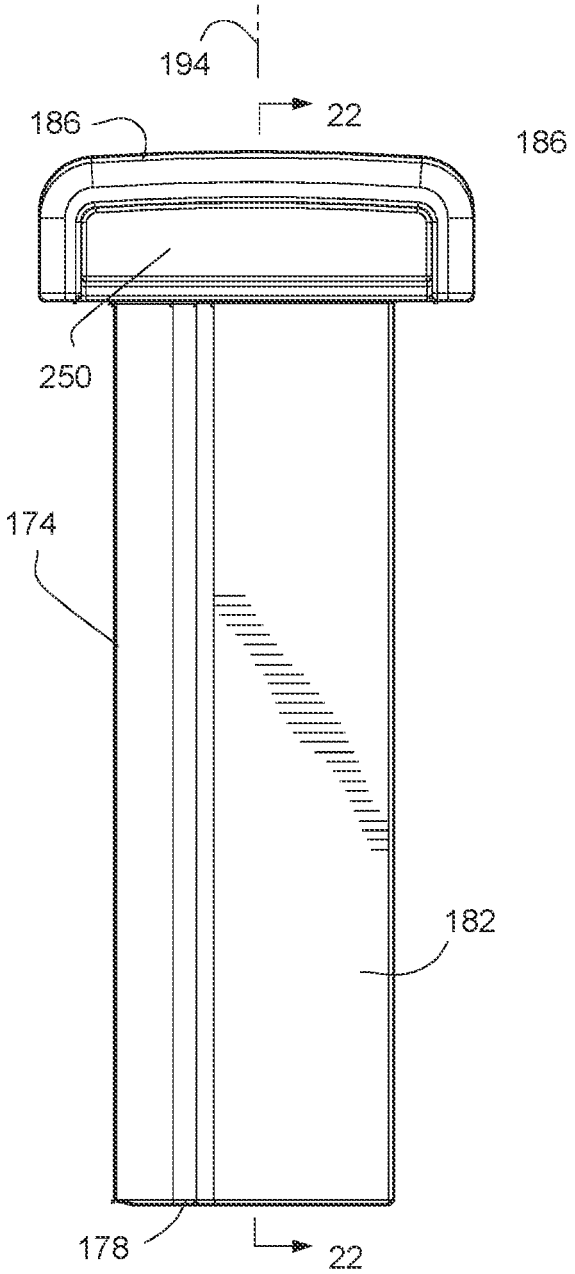
FIG. 21 is a side view of the plunger of FIG. 18.
Figure 22:
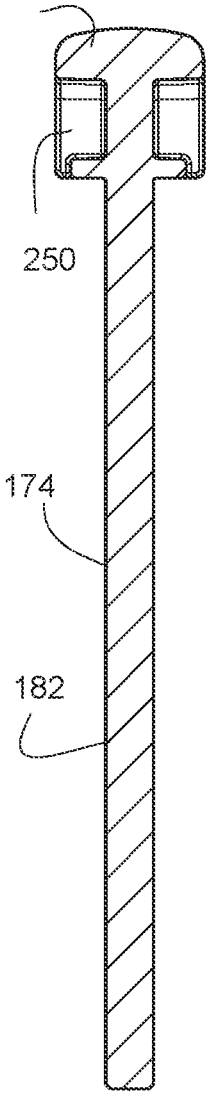
FIG. 22 is a cross-sectional end view of the plunger of FIG. 18, taken along line 22 of FIG. 21.

In another aspect, the enlarged opening 110 of the collar 114 can be sized and shaped to form an interference fit with the open proximal end 22 of the magazine 18. The interference-fit can be sufficient to maintain the magazine 18 in the collar 114 under the weight of the magazine 18 loaded with cartridges 14. Referring to FIGS. 11 and 13, elongated ribs 168 can be positioned in the enlarged opening 110 of the collar to form fitment guides to provide an interference or friction fit with the open proximal end 22 of the magazine 18. The ribs 168 can extend from an inner wall of the enlarged opening 110 and can be oriented longitudinally with respect to the enlarged opening 110 and the sleeve 26. The ribs 168 can be in pairs and each rib 168 can oppose an opposite riv 168 across the enlarged opening 110. There may be four ribs 168 with a pair of fore ribs positioned closer to a front of the enlarged opening 110 and the sleeve 26, and a pair of aft ribs positioned closer a rear of the enlarged opening 110 and the sleeve 26.

Referring again to FIGS. 1-26, in another aspect, a flange 170 can be positioned between the enlarged opening 110 of the collar 114 and the hollow 34 of the sleeve 26. The flange 170 can abut to the open proximal end 22 of the magazine 18 to position the open proximal end 22 of the magazine 18 to receive cartridges 14 from the hollow 34.

In one aspect the sleeve 26 and the collar 114 can be integrally formed as a single integral body. The sleeve 26 and the collar 114 can be formed of plastic and can be formed by injection molding.

Figure 6:
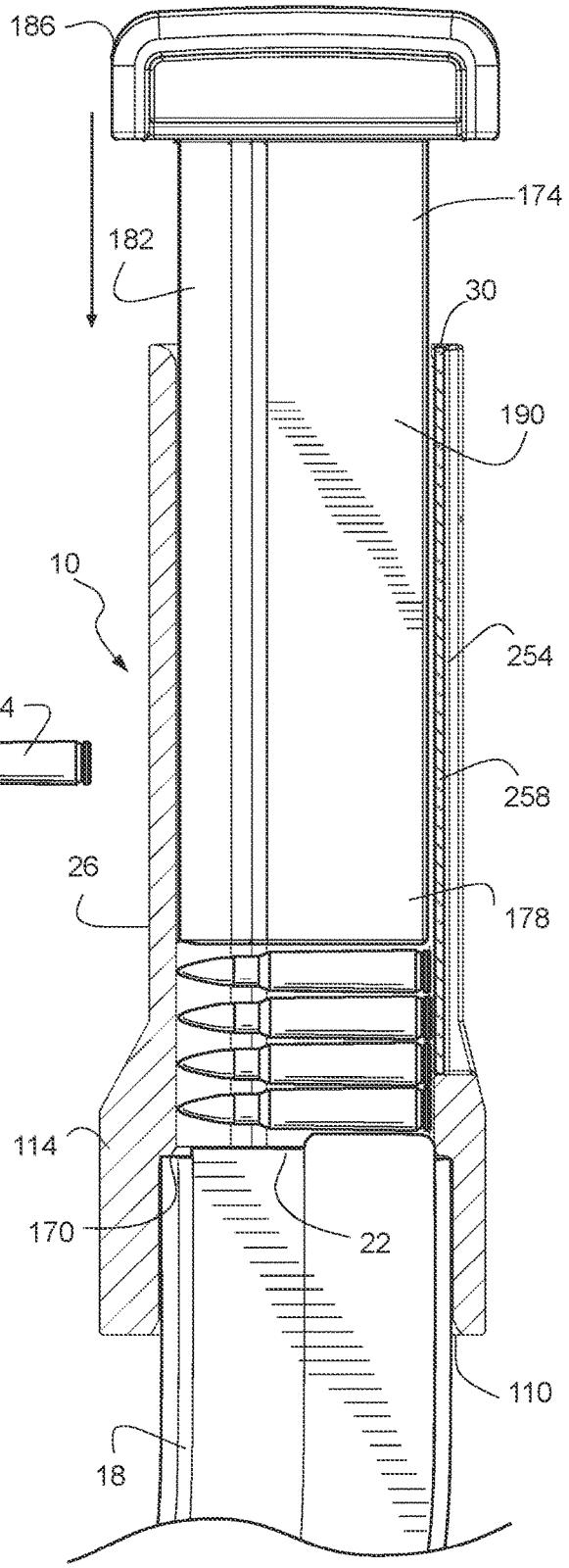
FIG. 6 is a partial cross-sectional side view of the magazine loader of FIG. 1, schematically showing the plunger pushing the cartridges into the magazine.

The loader 10 can also comprise a plunger 174 slidable in the hollow 34 of the sleeve 26 to press and expel the stack of cartridges 14 from the hollow 34 and into the magazine 18, as shown in FIG. 6. The plunger 174 can have a proximal end 178 selectively receivable in the open distal end 30 of the sleeve 26. The proximal end 178 of the plunger 174 can abut to an uppermost cartridge in the stack of cartridges 14. The plunger 174 can have an elongated shank 182 slidable in the hollow 34 of the sleeve 26. The plunger 174 can also have an enlarged head 186 to facilitate gripping and handling of the plunger 174. The plunger 174 and the shank 182 can have a withdrawn position in which the plunger 174 is separated from the sleeve 26 and the shank 182 is withdrawn from the hollow 34 to allow loading cartridges 14. The plunger 174 and the shank 182 can also have a plunge configuration in which the shank 182 is inserted into the open distal end 30 of the sleeve 26 to press against the stack of cartridges 14. The plunger 174 and the shank 182 can also have an expelled configuration in which the shank 182 is fully inserted into the hollow 34 and the enlarged head 186 can abut to the open distal end 30 of the sleeve 26. Thus, the plunger 174 can press the stack of cartridges 14 through the hollow 34 of the sleeve 26, out the enlarged opening 110 of the collar 114, through the open proximal end 22 of the magazine 18 and into the magazine 18.

In one aspect, the elongated shank 182 and the proximal end 178 of the plunger 174 can have a shape to match the hollow 34 to indicated proper alignment with the hollow 34 and resist binding between the cartridges 14 and a gap or space between the hollow 34 and the shank 182. In addition, the elongated shank 182 can have the shape to match the cartridges 14 to better distribute force along the length of the cartridge 14 to resist binding. The elongated shank 182 of the plunger 174 can have a cartridge-shaped outer wall 190 with or formed by a cross-sectional profile of the plunger 174 taken perpendicularly to a longitudinal axis 194 (FIG. 20) of the plunger 174. The cartridge-shaped outer wall 190 can have a shape to match the cartridge-shaped inner wall 38 of the hollow 34 of the sleeve 26 and to match the cross-sectional profile 46 of the cartridge 14 of the stack of cartridges 14.

Figure 26:
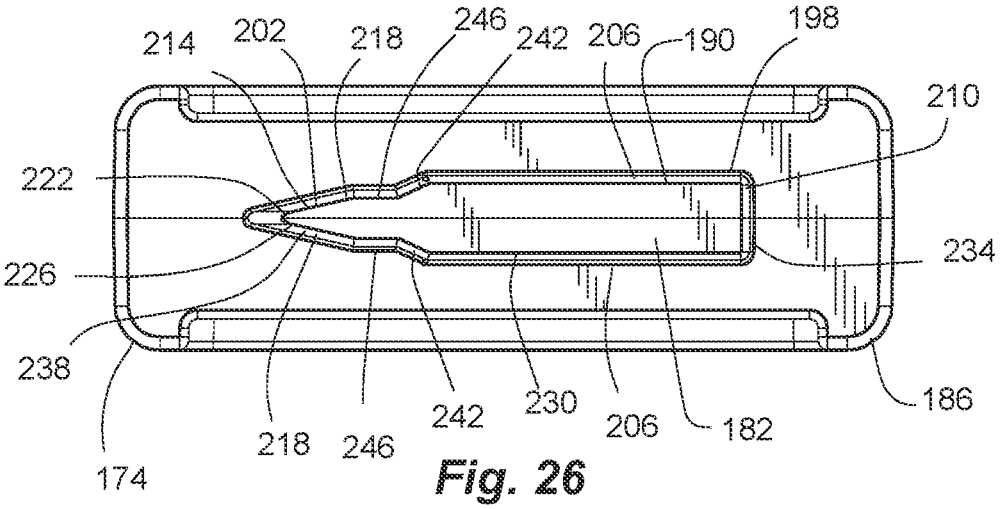
FIG. 26 is a bottom view of the plunger of FIG. 18.
Figure 27:
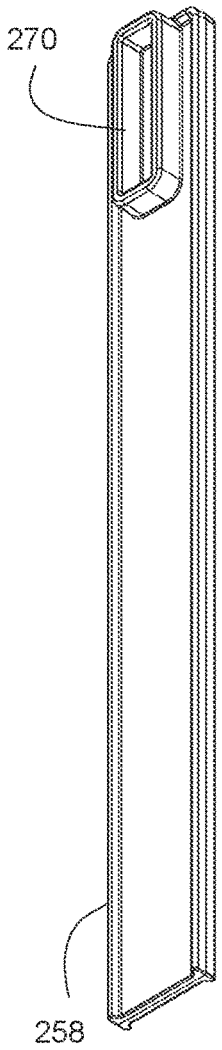
FIG. 27 is a rear perspective view of an example slide of the magazine loader of FIG. 1, according to an embodiment.
Figure 28:
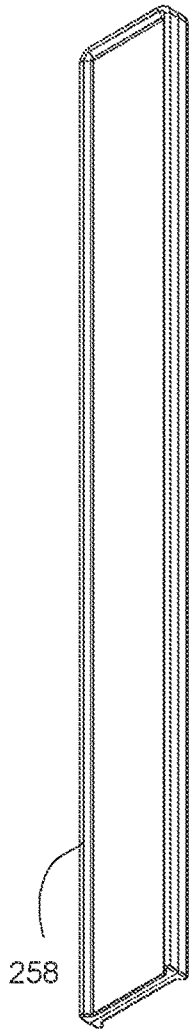
FIG. 28 is a front perspective view of the slide of FIG. 27.
Figure 29:
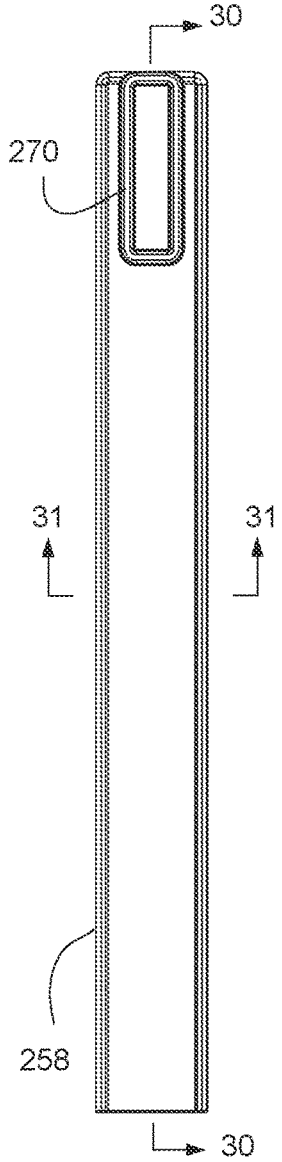
FIG. 29 is a rear view of the slide of FIG. 27.
Figure 30:
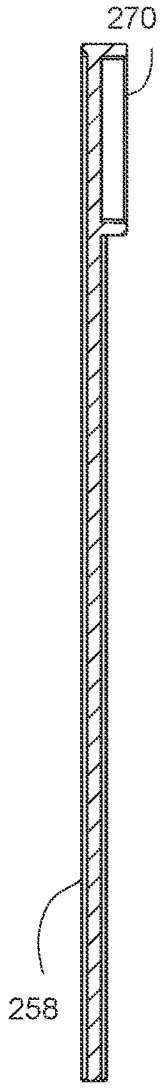
FIG. 30 is a cross-sectional side view of the slide of FIG. 27, taken along line 30 of FIG. 29.
Figure 31:
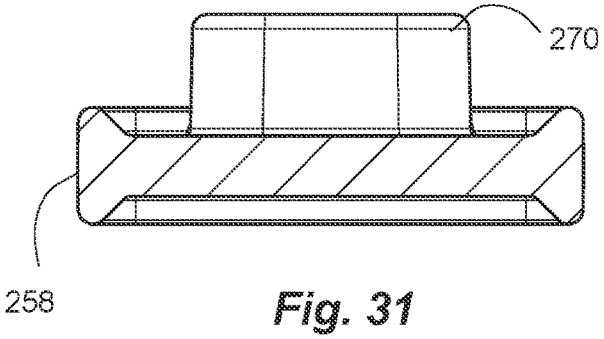
FIG. 31 is a cross-sectional end view of the slide of FIG. 27, taken along line 31 of FIG. 29.
Figure 32:
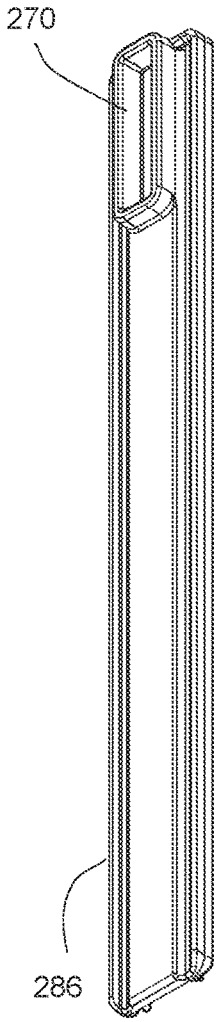
FIG. 32 is a rear perspective view of an example clip slide of the magazine loader of FIG. 1, according to an embodiment.
Figure 33:
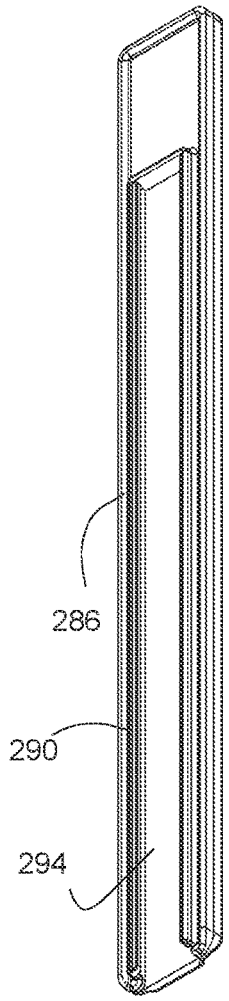
FIG. 33 is a front perspective view of the clip slide of FIG. 32.
Figure 34:
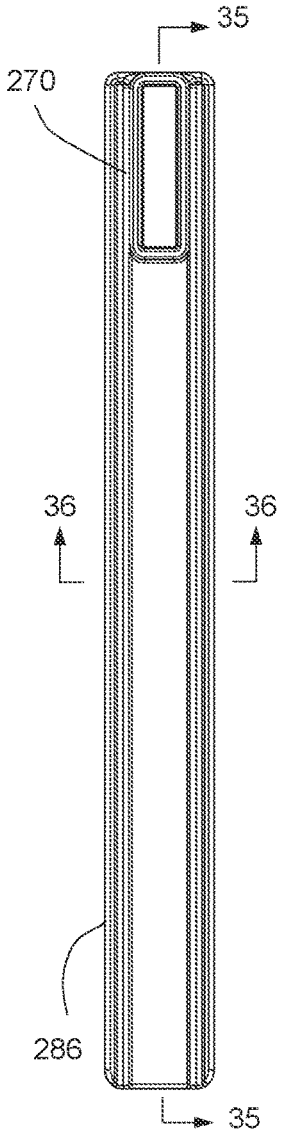
FIG. 34 is a rear view of the clip slide of FIG. 32.
Figure 35:
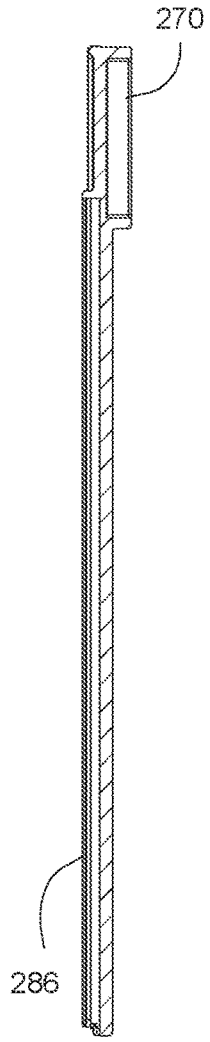
FIG. 35 is a cross-sectional side view of the clip slide of FIG. 32, taken along line 35 of FIG. 34.
Figure 36:
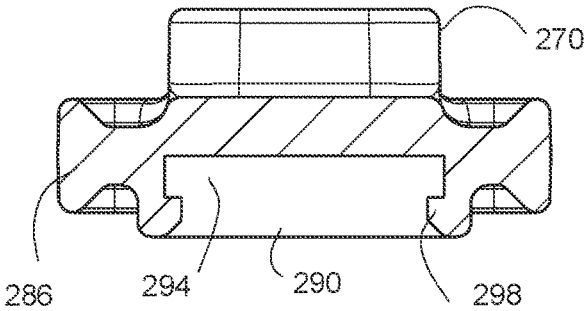
FIG. 36 is a cross-sectional end view of the clip slide of FIG. 32, taken along line 36 of FIG. 34.

Referring to FIGS. 24 and 26, the cartridge-shaped outer wall 190 can have a cross-sectional profile that can comprise at least a rear rectangular shape 198 and a forward ogive shape 202. The rear rectangular shape 198 can comprise a pair of rear walls 206 that are straight, positioned closer to a rear 210 of the loader 10 and the shank 182, spaced-apart from one another, and oriented substantially parallel with respect to one another. The rear rectangular shape 198 and the pair of rear walls 206 can correspond to the body 70 of the case 74 of the cartridge 14. The forward ogive shape 202 can comprise an ogive 214 with a pair of front walls 218 that are curved or strasight, positioned closer to a front 222 of the loader 10 and the shank 182, and oriented transvers to one another to culminate in a tip 226. The ogive 214 can correspond to the bullet 94 of the cartridge 14. The cartridge-shaped outer wall 190 can also comprise a continuous perimeter 230 extending from a rear end 234 of the shape closer to the rear 210 of the loader 10 and the shank 182, and around a front end 238 of the shape closer to the front 222 of the loader 10 and the shank 182. The elongated shank 182 of the plunger 174 can have a proximal end 178 with a length between front and rear ends 222 and 210 that extends substantially an entire length of the cartridge 14 to more evenly distribute force.

In another aspect, the cartridge-shaped outer wall 190 of the elongated shank 182 of the plunger 174 can extend substantially an entire length of the elongated shank 182 to resist binding or catching of the shank 182 in the hollow 34. The cartridge-shaped outer wall 190 can be configured to match a specific caliber.

In another aspect, the cartridge-shaped inner wall 190 can be configured to further match a .223 or 5.56 NATO caliber cartridge. Thus, the cartridge-shaped outer wall 190 can further comprise a pair of intermediate angled walls 242 that are straight, positioned intermediate the pair of rear walls 206 and the ogive 214, spaced-apart from one another, and oriented transverse to one another. The pair of intermediate angled walls 242 can correspond to the shoulder 122 of the case 74 of the cartridge 14. The cartridge-shaped outer wall 190 can further comprise a pair of intermediate straight walls 246 that are straight, positioned intermediate the pair of intermediate angled walls 242 and the ogive 214, spaced-apart from one another, and oriented substantially parallel with respect to one another. The pair of intermediate straight walls 246 can correspond to the neck 130 of the case 74 of the cartridge 14. Again, the cartridge-shaped outer wall 190 can also comprise a continuous perimeter 230 extending from the rear end 234 of the shape closer to the rear 210 of the loader 10 and the shank 182, and around the front end 238 of the shape closer to the front 222 of the loader 10 and the shank 182. In another aspect, the entire cartridge-shaped outer wall 190 can match the entire profile of the cartridge 14 and the hollow 34.

Referring again to FIGS. 1-26, in one aspect, the enlarged head 186 of the plunger 174 can have a size greater than the sleeve 26 to facilitate gripping and operation. In another aspect, the enlarged head 186 can have lateral indentations 250 (FIGS. 18 and 22) to facilitate withdrawal of the plunger 174 from the sleeve 26, and of the shank 182 from the hollow 34. In one aspect, the plunger 174 can be formed of plastic and can be formed by injection molding.

Figure 7:
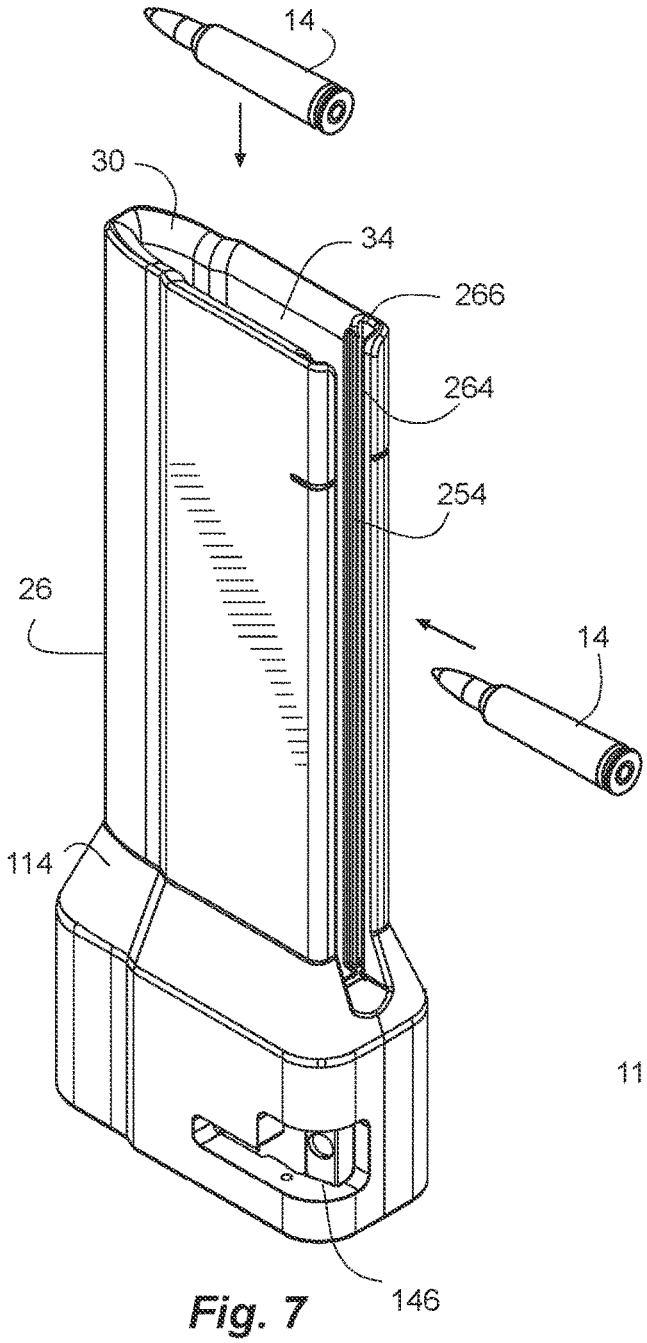
FIG. 7 is a perspective view of an example of the sleeve of the magazine loader of FIG. 1, according to an embodiment.
Figure 8:
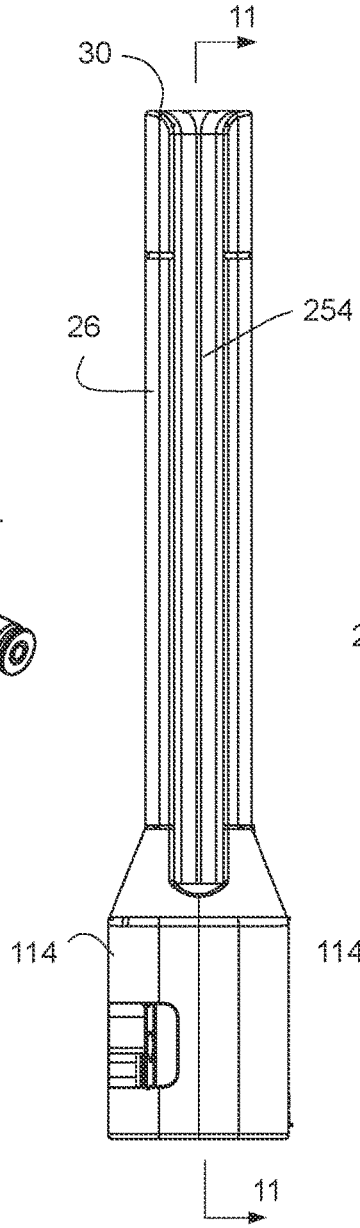
FIG. 8 is a rear view of the sleeve of FIG. 7.
Figure 9:
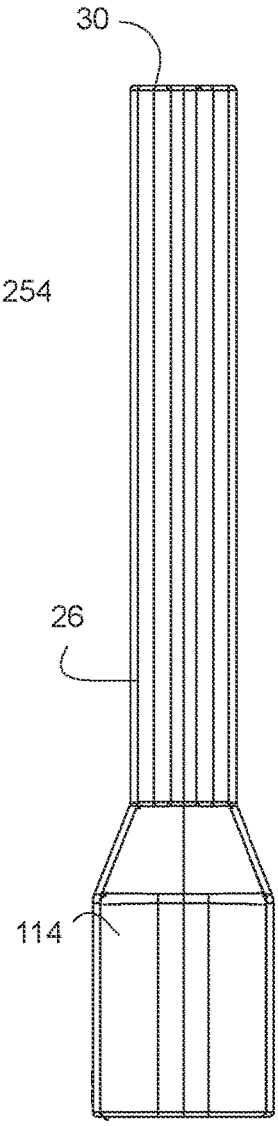
FIG. 9 is a front view of the sleeve of FIG. 7.
Figure 12:
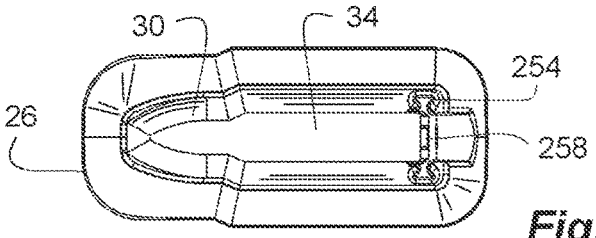
FIG. 12 is a top view of the sleeve of FIG. 7.
Figure 10:
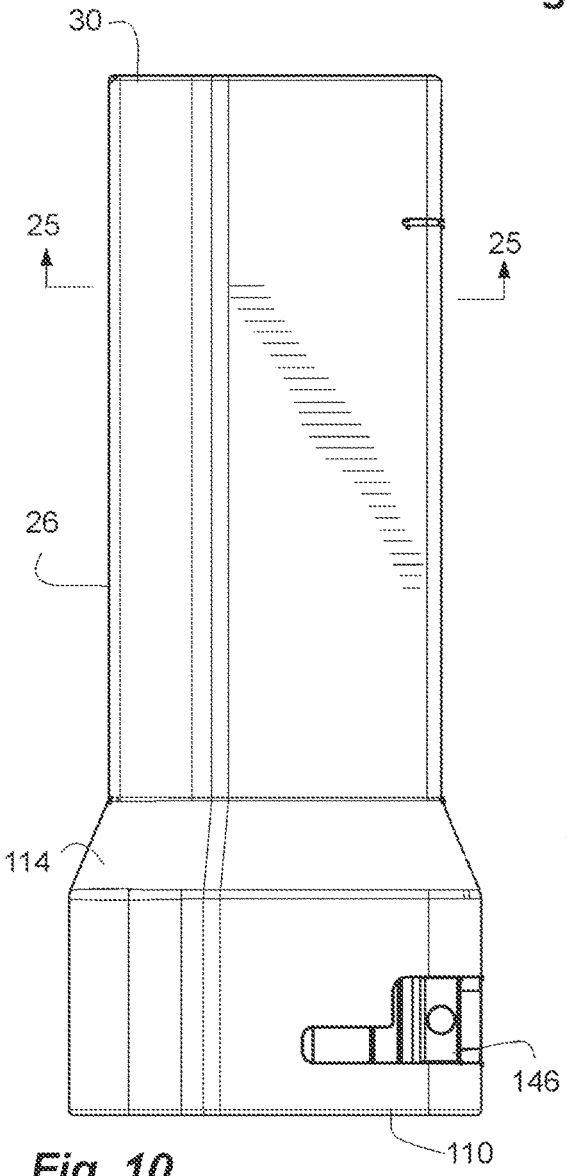
FIG. 10 is a side view of the of the sleeve of FIG. 7.

The loader 10 and the sleeve 26 can also comprise an elongated slot 254 in a rear end of the sleeve 26, as shown in FIGS. 7 and 25. The slot 254 can extend from the open distal end 30 of the sleeve 26 to the collar 114. The slot 254 can have a width sized to receive cartridges 14 therethrough. Thus, the loader 10 can comprise pair of cartridge inlets configured to receive cartridges 14 from two different directions into the hollow 34 of the sleeve 26. The different cartridge inlets allow ease of loading and stacking of cartridges 14 in the hollow 34 of the sleeve 26. The pair of cartridge inlets includes the open distal end 30 of the sleeve 26 and elongated slot 254 of the sleeve 26.

Referring to FIGS. 1-31, an elongated slide 258 can be selectively positioned in the elongated slot 254 to close the slot 254, as shown in FIG. 6. Thus, the slide 258 can resist inadvertent spilling of cartridges 14 from the hollow 34 through the slot 254. In one aspect, a pair of opposing channels 262 (FIG. 25) can oppose one another on opposite sides of the slot 254 in the sleeve 26. Opposite sides of the slide 258 can be slidably received in the pair of channels 262. The elongated slot 254 can have an open end 266 (FIG. 7) at the open distal end 30 of the sleeve 26. The elongated slide 258 can be insertable into the elongated slot 254 through the open end 266. A protrusion 270 can extend from the elongated slide 258 and can be engageable to slide the elongated slide 258 out of the elongated slot 254. The slide 258 can have opposite enlarged ribs intercoupled by a web.

In another aspect, the slide 258 can be removed, and a stripper clip 274 (FIG. 25) can be slidably insertable into the elongated slot 254 with the elongated slide 258 removed from the elongated slot 254. The stripper clip 274 can carry a plurality of cartridges 14. Thus, the loader 10 and the sleeve 26 can accommodate multiple cartridges 14 carried by the stripper clip 274, as well as multiple separated cartridges 14. The stripper clip 274 can be a strip of metal formed into a channel with a C-shaped cross-section to engage an extractor groove 278 and a rim 282 of the case 74 of the cartridge 14.

Referring to FIGS. 32-36, in another aspect, the loader 10 can also comprise a clip slide 286 similar to the slide 258 described herein, but with a rim grabber. The clip slide 286 can have an elongated clip 290 with a clip channel 294 configured to receive a plurality of cartridges 14, like a stripper clip. The cartridges 14 can be loaded into the clip channel 294 of the clip slide 286, and the clip slide 286 can be inserted into the slot 254 while the cartridges 14 are simultaneously inserted into the hollow 34. In another aspect, the loader 10 can have at least two slides, including the slide 258 and the clip slide 286. The elongated clip 290 with the clip channel 294 can comprise a pair of elongated rails 298 extending along a longitudinal axis of the clip slide 286 on an inner surface of the clip slide 286. The pair of rails 298 can be spaced-apart to form the clip channel 294 therebetween. In another aspect, the clip 290 and the clip channel 294 can be open at an end so that the clip 290 can be slide along a row of cartridges 14 in a box with an annular rim 282 of the case 74 received in the clip channel 294 to swiftly load the clip slide 286 with cartridges 14.

In one aspect, the slide 258 and the clip slide 286 can be formed of plastic and can be formed by injection molding.

In another aspect, the sleeve can have a narrow slot to allow viewing the capacity or fill level (or progress of the plunger) in the hollow of the sleeve. The narrow slot can be open or can be closed by a translucent or transparent window. In another aspect, the slide can be translucent or transparent to enable viewing the capacity and fill level (and progress of the plunger) in the hollow of the sleeve.

In one aspect, the hollow can have a length from the open distal end to the collar. In another aspect, the plunger can have an elongated shank with a length from the enlarged head to a distal free end greater than the length of the hollow. Thus, the shank of the plunger can extend beyond the length of the hollow to expel the cartridges from the hollow and into the magazine.

In another aspect, the sleeve can have a neck with an exterior size, such as a width or circumference. In another aspect, the collar can have an exterior size, such as a width or circumference greater than the exterior size of the neck. The size of the neck of the sleeve can facilitate grasping. In another aspect, the exterior of the sleeve and/or the plunger can have indicium indicating the caliber of the cartridge the hollow of the sleeve is designed for. In another aspect, the exterior of the collar can have indicium indicating the size or type of magazine the enlarged opening is designed for.

A method for loading cartridges 14 into a magazine 18 of a firearm, and for using the magazine loader 10 as described above, can comprise inserting an open proximal end 22 of the magazine 18 into an enlarged opening 110 of a collar 114 at a proximal end of an elongated sleeve 26. Cartridges 14 can be fed into an inlet opening 30 and/or 254 of the sleeve 26. In one aspect, the inlet opening can be an open distal end 30 of the sleeve 26. Thus, cartridges 14 can be fed into the open distal end 30 of the sleeve 26. In another aspect, the inlet opening can be an elongated slot 254 in a rear end of the sleeve 26 extending from the open distal end 30 of the sleeve 26 to the collar 114. Thus, the cartridges 14 can be fed through the slot 254 and onto a stack of cartridges 14 in the hollow 34. The cartridges 14 can be stacked in a hollow 34 of the sleeve 26 to form a stack of cartridges 14 at a proximal end of the hollow 34 proximate the enlarged opening 110 of the collar 114 and abutting to the open proximal end 22 of the magazine 18. The hollow 34 can have a cross-sectional shape that substantially matches a profile of the cartridges 14 to resist binding and/or misalignment. A proximal end 178 of a plunger 174 can be inserted into an open distal end 30 of the sleeve 26 opposite the enlarged opening 110 of the collar 114. An enlarged head 186 of the plunger 174 can be pressed against and into the hollow 34 to force the cartridges 14 from the hollow 34 of the sleeve 26, through the open proximal end 22 of the magazine 18, and into the magazine 18. In one aspect, an elongated slide 258 can be inserted into the elongated slot 254 to close the slot 254 prior to pressing against the enlarged head 186 of the plunger 174. In another aspect, a closed distal end of the magazine 28 can be fixed against a stop opposite the plunger 174 prior to pressing against the enlarged head 186 of the plunger 174. The open proximal end 22 of the magazine 18 with the cartridges 14 in the magazine 18 can be removed from the enlarged opening 110 of the collar 114 of the sleeve 26. As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The terms "interference fit" and "friction fit" and "press-fit" are terms of art used interchangeably herein to refer to deliberately causing, increasing and/or using friction to deliberately resist movement. An interference fit or friction fit is different than and great than the existence of friction. While friction may exist between any two surfaces, is often desirable to do all one can to reduce this friction. An interference fit or friction fit can be distinguished from naturally occurring friction by being actually deliberately caused and increased. An interference fit can be created by dimensioning engaging parts so that their surfaces tightly bear against one another. A friction fit can be created by surface roughness that is rougher.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A loader configured to assist in loading cartridges into a magazine of a firearm, comprising:

an elongated sleeve having an open distal end and a hollow therethrough extending from the open distal end, the hollow sized and shaped to receive a stack of cartridges;

the hollow having a cartridge-shaped inner wall formed by a cross-sectional profile of the hollow taken perpendicularly to a longitudinal axis of the hollow, the cartridge-shaped inner wall having a shape configured to match a cross-sectional profile of a cartridge of the stack of cartridges taken along a longitudinal axis of the cartridge;

a collar at a proximal end of the sleeve and having an enlarged opening sized and shaped to receive an open proximal end of the magazine;

a plunger with a proximal end selectively receivable in the open distal end of the sleeve, and having an elongated shank slidable in the hollow of the sleeve and an enlarged head, the plunger configured to press the stack of cartridges through the hollow of the sleeve, out the enlarged opening of the collar, through the open proximal end of the magazine and into the magazine;

the elongated shank of the plunger having a cartridge-shaped outer wall formed by a cross-sectional profile of the plunger taken perpendicularly to a longitudinal axis of the plunger, the cartridge-shaped outer wall having a shape to match the cartridge-shaped inner wall of the hollow of the sleeve and configured to match the cross-sectional profile of the cartridge of the stack of cartridges; and each of the cartridge-shaped inner wall of the hollow and the cartridge-shaped outer wall of the shank comprising at least:

a pair of rear walls that are straight, positioned closer to a rear of the loader, spaced-apart from one another, oriented substantially parallel with respect to one another, and configured to correspond to a body of a case of the cartridge; and an ogive with a pair of front walls that are curved, positioned closer to a front of the loader, and oriented transvers to one another to culminate in a tip, and configured to correspond to a bullet of the cartridge.

2. The loader in accordance with claim 1, wherein each of the cartridge-shaped inner wall and the cartridge-shaped outer wall further comprise:

a pair of intermediate angled walls that are straight, positioned intermediate the pair of rear walls and the ogive, spaced-apart from one another, and oriented transverse to one another, and configured to correspond to a shoulder of the case of the cartridge; and a pair of intermediate straight walls that are straight, positioned intermediate the pair of intermediate angled walls and the ogive, spaced-apart from one another, and oriented substantially parallel with respect to one another, and configured to correspond to a neck of the case of the cartridge.

3. The loader in accordance with claim 1, wherein each of the cartridge-shaped inner wall and the cartridge-shaped outer wall further comprise:

a continuous perimeter extending from a rear end of the shape closer to the rear of the loader and around a front end of the shape closer to the front of the loader.

4. The loader in accordance with claim 1, further comprising:

at least one cartridge located in the hollow of the sleeve; and the cartridge-shaped inner wall of the hollow of the sleeve having a perimeter matching the cross-sectional profile of the at least one cartridge from a rear of the at least one cartridge and around a front end of the cartridge.

5. The loader in accordance with claim 4, wherein the elongated shank of the plunger has a proximal end with a length between front and rear ends that extends an entire length of the at least one cartridge.

6. The loader in accordance with claim 1, wherein the cartridge-shaped inner wall of the hollow of the sleeve extends substantially an entire length of the hollow along the longitudinal axis from the open distal end of the sleeve to the enlarged opening of the collar.

7. The loader in accordance with claim 1, wherein the cartridge-shaped outer wall of the elongated shank of the plunger extends substantially an entire length of the elongated shank.

8. The loader in accordance with claim 1, further comprising:

an elongated slot in a rear end of the sleeve, the slot extending from the open distal end of the sleeve to the collar, the slot having a width sized to receive cartridges therethrough; and an elongated slide selectively positioned in the elongated slot to close the slot.

9. The loader in accordance with claim 8, further comprising:

a pair of opposing channels opposing one another on opposite sides of the slot in the sleeve; and opposite sides of the slide being slidably received in the pair of channels.

10. The loader in accordance with claim 8, further comprising:

the elongated slot having an open end at the open distal end of the sleeve; and the elongated slide being insertable into the elongated slot through the open end.

11. The loader in accordance with claim 8, further comprising:

a protrusion extending from the elongated slide and engageable to slide the elongated slide out of the elongated slot.

12. The loader in accordance with claim 8, further comprising:

a pair of cartridge inlets configured to receive cartridges from two different directions into the hollow of the sleeve, including the open distal end of the sleeve and elongated slot of the sleeve.

13. The loader in accordance with claim 8, further comprising:

a stripper clip slidably insertable into the elongated slot with the elongated slide removed from the elongated slot.

14. A loader configured to assist in loading cartridges into a magazine of a firearm, comprising:

an elongated sleeve having an open distal end and a hollow therethrough extending from the open distal end, the hollow sized and shaped to receive a stack of cartridges;

the hollow having a cartridge-shaped inner wall formed by a cross-sectional profile of the hollow taken perpendicularly to a longitudinal axis of the hollow, the cartridge-shaped inner wall having a shape configured to match a cross-sectional profile of a cartridge of the stack of cartridges taken along a longitudinal axis of the cartridge;

a collar at a proximal end of the sleeve and having an enlarged opening sized and shaped to receive an open proximal end of the magazine;

a plunger with a proximal end selectively receivable in the open distal end of the sleeve, and having an elongated shank slidable in the hollow of the sleeve and an enlarged head, the plunger configured to press the stack of cartridges through the hollow of the sleeve, out the enlarged opening of the collar, through the open proximal end of the magazine and into the magazine;

the elongated shank of the plunger having a cartridge-shaped outer wall formed by a cross-sectional profile of the plunger taken perpendicularly to a longitudinal axis of the plunger, the cartridge-shaped outer wall having a shape to match the cartridge-shaped inner wall of the hollow of the sleeve and configured to match the cross-sectional profile of the cartridge of the stack of cartridges;

each of the cartridge-shaped inner wall and the cartridge-shaped outer wall comprising at least:

a pair of rear walls that are straight, positioned closer to a rear of the loader, spaced-apart from one another, oriented substantially parallel with respect to one another, and configured to correspond to a body of a case of the cartridge;

an ogive with a pair of front walls that are curved, positioned closer to a front of the loader, and oriented transvers to one another to culminate in a tip, and configured to correspond to a bullet of the cartridge; and a continuous perimeter extending from a rear end of the shape closer to the rear of the loader and around a front end of the shape closer to the front of the loader;

the cartridge-shaped inner wall of the hollow of the sleeve extending substantially an entire length of the hollow along the longitudinal axis from the open distal end of the sleeve to the enlarged opening of the collar;

the cartridge-shaped outer wall of the elongated shank of the plunger extending substantially an entire length of the elongated shank;

an elongated slot in a rear end of the sleeve, the slot extending from the open distal end of the sleeve to the collar, the slot having a width sized to receive cartridges therethrough; and an elongated slide selectively positioned in the elongated slot to close the slot.

15. The loader in accordance with claim 14, wherein each of the cartridge-shaped inner wall and the cartridge-shaped outer wall further comprise:

a pair of intermediate angled walls that are straight, positioned intermediate the pair of rear walls and the ogive, spaced-apart from one another, and oriented transverse to one another, and configured to correspond to a shoulder of the case of the cartridge; and a pair of intermediate straight walls that are straight, positioned intermediate the pair of intermediate angled walls and the ogive, spaced-apart from one another, and oriented substantially parallel with respect to one another, and configured to correspond to a neck of the case of the cartridge.

16. The loader in accordance with claim 14, further comprising:

at least one cartridge located in the hollow of the sleeve; and the cartridge-shaped inner wall of the hollow of the sleeve having a perimeter matching the cross-sectional profile of the at least one cartridge from a rear of the at least one cartridge and around a front end of the cartridge.

17. The loader in accordance with claim 16, wherein the elongated shank of the plunger has a proximal end with a length between front and rear ends that extends an entire length of the at least one cartridge.

18. The loader in accordance with claim 14, further comprising:

a pair of cartridge inlets configured to receive cartridges from two different directions into the hollow of the sleeve, including the open distal end of the sleeve and elongated slot of the sleeve.

19. The loader in accordance with claim 14, further comprising:

a stripper clip slidably insertable into the elongated slot with the elongated slide removed from the elongated slot.

20. A loader to assist in loading cartridges into a magazine of a firearm, comprising:

an elongated sleeve having an open distal end and a hollow therethrough extending from the open distal end, the hollow sized and shaped to receive a stack of cartridges;

the hollow having a cartridge-shaped inner wall formed by a cross-sectional profile of the hollow taken perpendicularly to a longitudinal axis of the hollow, the cartridge-shaped inner wall having a shape to match a cross-sectional profile of a cartridge of the stack of cartridges taken along a longitudinal axis of the cartridge;

a collar at a proximal end of the sleeve and having an enlarged opening sized and shaped to receive an open proximal end of the magazine;

a plunger with a proximal end selectively receivable in the open distal end of the sleeve, and having an elongated shank slidable in the hollow of the sleeve and an enlarged head, the plunger configured to press the stack of cartridges through the hollow of the sleeve, out the enlarged opening of the collar, through the open proximal end of the magazine and into the magazine;

the elongated shank of the plunger having a cartridge-shaped outer wall formed by a cross-sectional profile of the plunger taken perpendicularly to a longitudinal axis of the plunger, the cartridge-shaped outer wall having a shape to match the cartridge-shaped inner wall of the hollow of the sleeve and to match the cross-sectional profile of the cartridge of the stack of cartridges;

each of the cartridge-shaped inner wall and the cartridge-shaped outer wall comprising at least:

a pair of rear walls that are straight, positioned closer to a rear of the loader, spaced-apart from one another, oriented substantially parallel with respect to one another, to correspond to a body of a case of the cartridge;

an ogive with a pair of front walls that are curved, positioned closer to a front of the loader, and oriented transvers to one another to culminate in a tip, to correspond to a bullet of the cartridge; and a continuous perimeter extending from a rear end of the shape closer to the rear of the loader and around a front end of the shape closer to the front of the loader;

the cartridge-shaped inner wall of the hollow of the sleeve having a perimeter matching the cross-sectional profile of the at least one cartridge from a rear of the at least one cartridge and around a front end of the cartridge;

the elongated shank of the plunger has a proximal end with a length between front and rear ends that extends an entire length of the cartridge;

the cartridge-shaped inner wall of the hollow of the sleeve extending substantially an entire length of the hollow along the longitudinal axis from the open distal end of the sleeve to the enlarged opening of the collar;

the cartridge-shaped outer wall of the elongated shank of the plunger extending substantially an entire length of the elongated shank;

an elongated slot in a rear end of the sleeve, the slot extending from the open distal end of the sleeve to the collar, the slot having a width sized to receive cartridges therethrough;

an elongated slide selectively positioned in the elongated slot to close the slot; and a pair of cartridge inlets to receive cartridges from two different directions into the hollow of the sleeve, including the open distal end of the sleeve and elongated slot of the sleeve.

* * * * *